United States Patent [19]

Roussin et al.

[11] Patent Number: 4,959,915

[45] Date of Patent: Oct. 2, 1990

[54] IMPACT BUCKET APPARATUS

[75] Inventors: Michael A. Roussin, Peoria; Brent C. Bargfrede, Dunlap, both of Ill.

[73] Assignee: Caterpillar Inc., Peoria, Ill.

[21] Appl. No.: 318,997

[22] Filed: Mar. 6, 1989

[51] Int. Cl.[5] ..... E02F 5/00

[52] U.S. Cl. ..... 37/141 R; 37/118 R; 37/DIG. 12; 37/DIG. 18; 172/40; 299/37; 299/67

[58] Field of Search ..... 37/DIG. 18, 118 R, 117.5, 37/103, DIG. 3, DIG. 12; 173/29, 46; 175/293; 166/177, 178; 299/37, 69, 67; 172/40

[56] References Cited

U.S. PATENT DOCUMENTS

| | | | |
|---|---|---|---|
| 2,228,445 | 1/1941 | De Velbiss | 173/46 X |
| 3,145,488 | 8/1964 | French | 37/DIG. 18 X |
| 3,305,953 | 2/1967 | Von Mehren et al. | 37/DIG. 18 X |
| 3,959,897 | 6/1976 | May | 37/DIG. 18 X |
| 4,003,603 | 1/1977 | Stemler et al. | 37/DIG. 18 X |
| 4,070,772 | 1/1978 | Motomura et al. | 173/46 X |
| 4,359,102 | 11/1982 | Gurries et al. | 37/DIG. 18 X |
| 4,379,595 | 4/1983 | Roussin et al. | 37/DIG. 18 X |
| 4,625,438 | 12/1986 | Mozer | 37/117.5 X |
| 4,715,265 | 12/1987 | Graul et al. | 91/170 R |

FOREIGN PATENT DOCUMENTS

| | | | |
|---|---|---|---|
| 972397 | 8/1975 | Canada | 37/DIG. 18 |
| 2041218 | 2/1971 | Fed. Rep. of Germany | 37/DIG. 18 |
| 1540070 | 2/1979 | United Kingdom | 37/DIG. 18 |

*Primary Examiner*—Dennis L. Taylor
*Assistant Examiner*—Franco S. DeLiguori
*Attorney, Agent, or Firm*—Calvin E. Glastetter

[57] ABSTRACT

Impact buckets are useful, for example, in fracturing rock and other hard material which is to be excavated. Known systems using vibrating mechanisms which are mechanically coupled to a cutting edge assembly do not produce forces high enough to efficiently fracture the rock or other hard material and send destructive vibration forces to the base vehicle. The subject impact bucket mechanism uses an impact hammer which is impact coupled to a cutting edge assembly to fracture rock and other hard material. This results in a force controlled system in which displacement varies with material resistance. The force levels achieved by the impact coupled system are higher than the vibrating system. Thus, the disclosed impact bucket mechanism can produce higher force levels which can more efficiently fracture the rock or the other hard material without sending destructive vibration to the base machine.

11 Claims, 3 Drawing Sheets

IMPACT BUCKET APPARATUS

TECHNICAL FIELD

This invention relates to a material excavating bucket and more particularly to a bucket having a pivotal cutting edge assembly and an impact hammer for impacting the cutting edge.

BACKGROUND ART

Vibrating bucket apparatuses are commonly employed to assist in the excavation of hard material such as rocks and frozen ground. Such bucket apparatuses generally include a vibrating mechanism which is connected to a u-shaped cutting edge assembly to pivotally reciprocate the cutting edge assembly in a fore and aft direction.

The bucket apparatuses in essence use a vibrating mechanism to move the u-shaped cutting edge assembly. One of the problems associated with the currently available vibrating bucket apparatuses is that the vibrating mechanisms do not provide the necessary force for the cutting edge to fracture the material which is to be excavated. The vibrating buckets operate on a displacement control technology and are limited to light duty applications and have limited performance and low reliability in harder materials. Also when marginal conditions are encountered dangerous and destructive vibration levels are sent back to the base vehicle. Another problem associated with current bucket apparatuses is that the cutting edge assembly is not guided during pivotal movement, therefore the cutting edge tends to move laterally and become distorted.

Various attempts have been made to provide a vibrating bucket apparatus to aid in excavation of hard material. The major disadvantage is that the vibrating mechanisms do not deliver enough force to the material and the u-shaped cutting edges tend to twist and distort.

The present invention is directed to overcoming one or more of the problems as set forth above.

DISCLOSURE OF THE INVENTION

In one aspect of the present invention an impact bucket apparatus is pivotally mounted on a movable manipulator. A bucket includes a pair of spaced apart side plates each having upper and lower portions. A bottom plate is attached to the bottom portion of each of the side plates. A curved body portion is attached to each of the upper portions of the side plates and spaced from the bottom plate. The side plates, the bottom plate, and the curved body portion define an impactor cavity within the bucket. A cutting edge assembly includes a pair of spaced apart arms having upper and lower portions and a cutting edge having an impact surface. The cutting edge is attached to the lower portions of the arms. The upper portions of the arms are pivotally attached to the upper portions of the side plates. An impact hammer is supported in the impactor cavity of the bucket and includes a piston having an impact surface aligned with the impact surface of the cutting edge.

The present invention uses impact technology and the pivotal cutting edge is not mechanically coupled to the impactor but is impact coupled. This results in a force controlled system in which displacement varies with the rock resistance. The force levels achieved by the impact coupled system is higher than the vibrating system and can exceed the strength of hard material to cause fractures. Vibration sent back to the base vehicle is reduced.

The impact bucket apparatus is constructed in a manner to provide an impact hammer which contacts a pivotal cutting edge. This allows the cutting edge to be impacted by the impact hammer to provide a large impact force to the material which is to be excavated. The pivotal cutting edge is guided during movement to prevent distortion.

BRIEF DESCRIPTION OF THE DRAWINGS

For a better understanding of the present invention, reference may be made of the accompanying drawings in which.

BEST MODE FOR CARRYING OUT THE INVENTION

Figure 1:
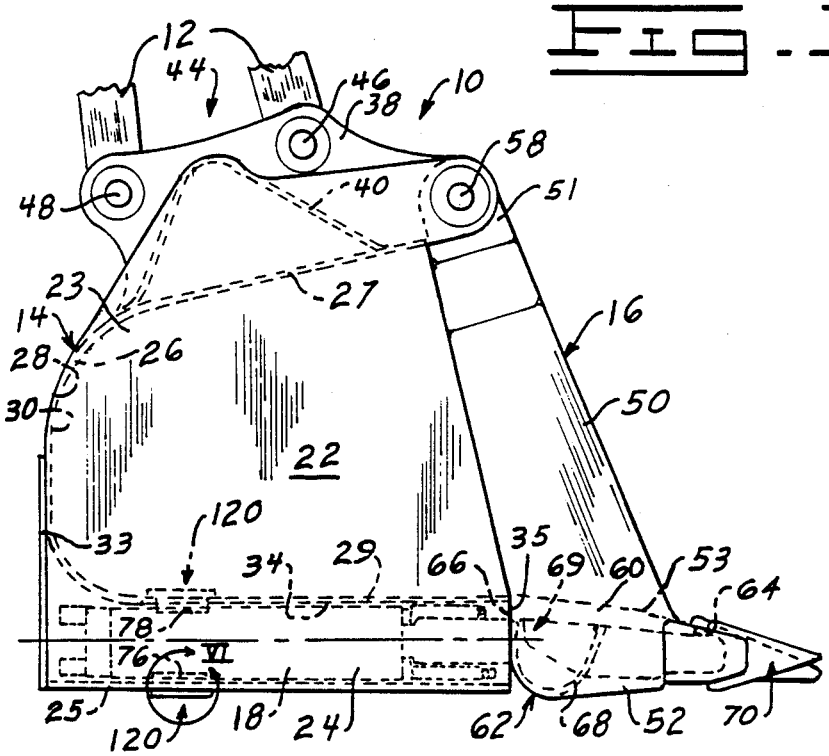
FIG. 1 is a side view of an embodiment of the present invention.
Figure 2:
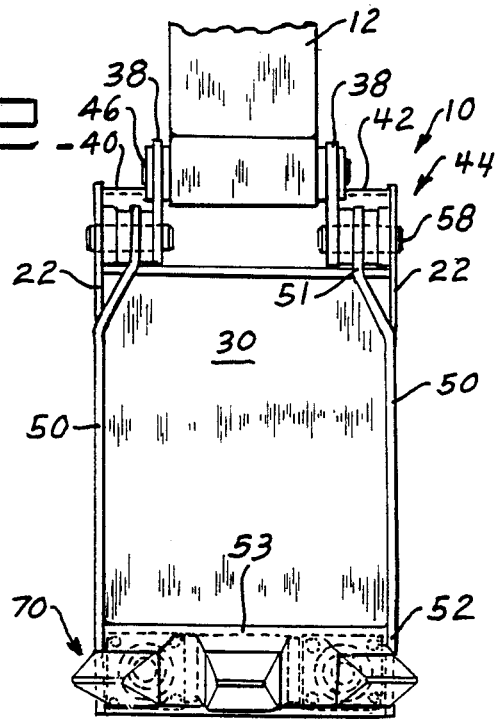
FIG. 2 is a front view of the embodiment of FIG. 1.
Figure 3:
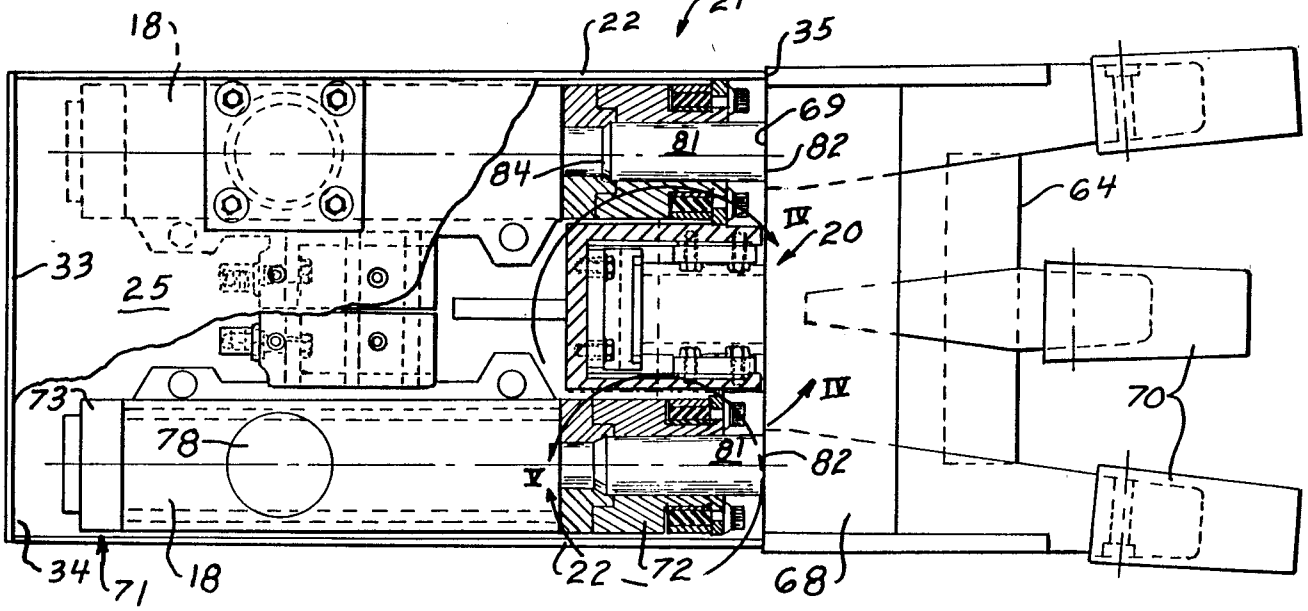
FIG. 3 is a partial section bottom view of the embodiment of FIG. 1.

As shown in the drawings, an impact bucket apparatus 10 is shown mounted on a movable manipulator 12. The impact bucket apparatus includes a bucket 14, a cutting edge assembly 16, a pair of impact hammers 18, means 20 for guiding and limiting pivotal movement of the cutting edge assembly 16, and means 21 for positioning the impact hammer 18 within the impact bucket apparatus 10.

The bucket 14 includes a pair of spaced side plates 22 each having an upper portion 23 and a lower portion 24. A bottom plate 25 is attached to the lower portions 24 at the bottom thereof. A curved body portion 26 is connected between the spaced side plates 22 and defines the top 27, back 28, and bottom or floor 29 of the bucket 14. The curved body portion 26 is spaced upwardly from the bottom plate 25. The spaced side plates and curved body portion 26 define a u-shaped material receiving cavity 30. A rear plate 33 is removably attached, by suitable fastening means (not shown), to the back 28, the bottom plate 25, and the spaced side plates 22 . An impactor cavity 34 is defined in the bucket structure by the curved body portion 26, the bottom plate 25 and the spaced side plates 22. The impactor cavity 34 has an opening 35. The upper portions 23 of the side plates 22 individually extend a predetermined distance above the top of the curved body portion 26. A spaced pair of reinforcing plates 38 are attached to the top of the bucket 14 inwardly of the upwardly projecting portion of the side plates 22. A first gusset 40 is attached between the upwardly projecting portion of one of the side plates 22 and one of the reinforcing plates 38. A second gusset 42 is attached between the upwardly projecting portion of the other one of the side plates 22 and the other one of the reinforcing plates 38. The upwardly projecting portions of the side plates 22, the reinforcing plates 38 and the gussets 40,42 define a pair of mounting structures 44 for attaching the bucket 14 to the movable manipulator 12 by a first pin 46 and a second pin 48.

The cutting edge assembly 16 includes a pair of spaced apart arms 50 each having an upper portion 51 and a lower portion 52 and a cutting edge 53. The cutting edge 53 is attached between and to the lower portions 52 of the arms 50. A pair of pins 58 attach the upper portions 51 of the arms 50 to the mounting structures 44 for pivotal movement between a position adjacent the opening 35 of the impactor cavity 34 and a position spaced from the opening 35 of the impactor cavity 34. The cutting edge 53 includes a cutting element 60 and a support structure 62. The cutting element 60 has a material engaging first edge portion 64 and a second edge portion 66 adjacent the impactor opening 35. The support structure 62 includes a reinforcing gusset 68 which is attached to the bottom surface of the cutting element 60 adjacent the cavity 34 and extends between the side plates 22. The edge portion 66 and reinforcing gusset 68 define an impact surface 69. A plurality of teeth 70 are attached to the cutting edge assembly 16 to aid in penetration.

The pair of impact hammers 18 (in this specific embodiment two impact hammers are shown but a single hammer or more could be used), are positioned in the impactor cavity 34 of the bucket 14. Each impact hammer 18 has a housing 71 with a first end portion 72 adjacent the cutting edge assembly 16 and a second end portion 73 spaced from the cutting edge assembly 16. The first end portion 72 has a reduced diameter portion 74 with a plurality of locking tabs 75. The second end portion 73 includes a lower mounting recess 76 and a upper mounting recess 78. The housing 71 has a stepped central bore 79 having a shoulder 80. A first piston 81 is reciprocally mounted within the central bore 79 of the housing 71. The first piston 81 includes a first impact surface 82 aligned with and positioned to contact the impact surface 69 of the cutting edge assembly 16. The first piston also includes a second impact surface 83, within the central bore 79, opposite the first impact surface 82. A shoulder 84 on the piston 81 is positioned a predetermined distance between the first and second impact surfaces 82,83. The first piston 81 is movable between a retracted position wherein the shoulders 80 and 84 are in contact and a extended position wherein the shoulders 80 and 84 are spaced apart. A second piston 85 is also reciprocally mounted within the central bore 79. The second piston 85 includes a impact surface 86 positioned to contact the second impact surface 83 of the first piston 81.

Figure 4:
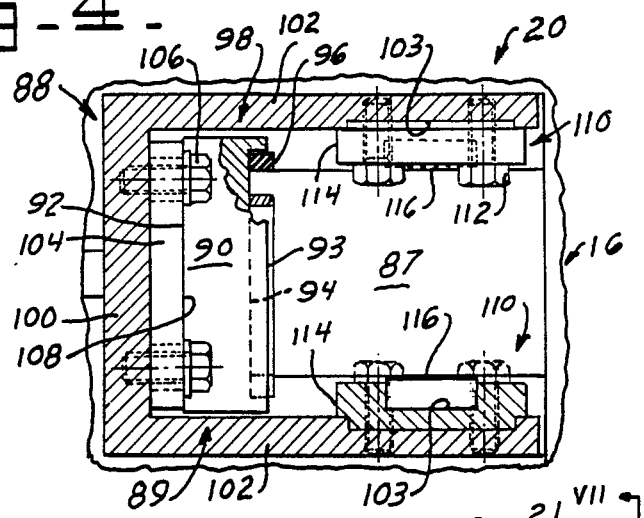
FIG. 4 is an enlarged partial sectional view as indicated in FIG. 3.

The guiding and limiting means 20, as best shown in FIG. 4, is positioned within the impactor cavity 34 defined by the side plates 22, the curved body portion 26, and the bottom plate 25. Means 20 includes a stub shaft 87 attached to the cutting edge assembly 16 and a mounting assembly 88 attached within the impactor cavity 34 of the bucket 14. The stub shaft 87 has a distal end 89 which projects into the mounting assembly 88. The distal end 89 includes an enlarged end portion 90 having an abutment surface 92 on one side and a surface 93 having a continuous axially facing groove 94 on the opposed side. An annular elastomeric insert 96 is positioned within the groove 94 and extends outwardly therefrom beyond the surface 93. The mounting assembly 88 includes a u-shaped plate 98, as shown in FIG. 4, having a central body portion 100 with a pair of spaced legs 102 projecting therefrom toward the cutting edge 50. Each leg 102 has a mounting recess 103 adjacent the cutting edge 50. A stop plate 104 is removably attached to the central body portion 100 of the mounting assembly 88 by a plurality of bolts 106. The stop plate 104 has an abutment surface 108 positioned to be contacted by the abutment surface 92 of the stub shaft 87 to limit movement of the cutting edge assembly 16 toward the bucket 14. A pair of stops 110, one attached to each of the spaced legs 102 of the u-shaped plate, are positioned and attached in the mounting recesses 103 of each leg 102 by a plurality of bolts 112. The stops 110 are positioned on opposite sides of the stub shaft 87. Each stop 110 includes an abutment surface 114 positioned for contact with the elastomeric insert 96. The elastomeric insert 96 cushions the contact and compresses or deforms to allow the surface 93 of the enlarged end portion 90 of the stub shaft 87 to also abut the stop 110 to limit the movement of the cutting edge assembly 16 away from the bucket 14. Each stop 110 also includes an insert 116 positioned to contact and guide the stub shaft 87 during pivotal movement of the cutting edge assembly 16.

Figure 5:
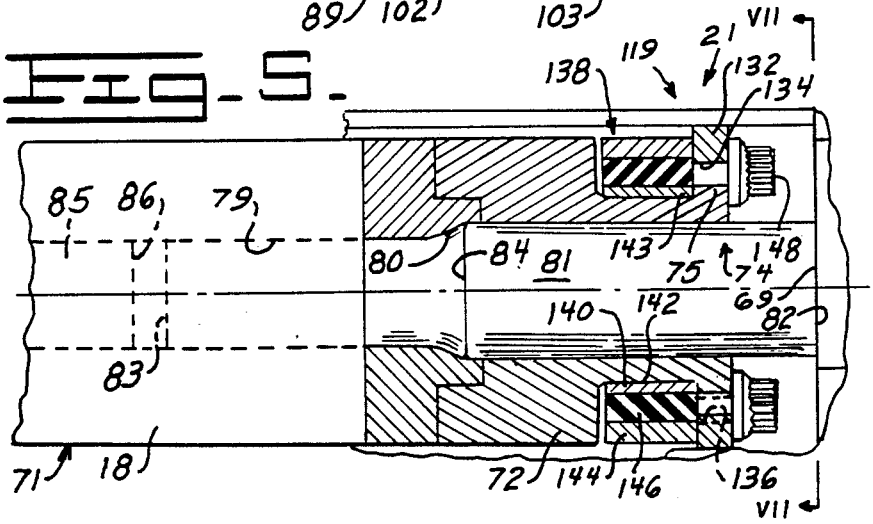
FIG. 5 is an enlarged partial sectional view as indicated in FIG. 3.
Figure 6:
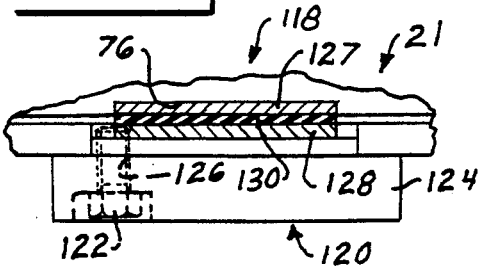
FIG. 6 is an enlarged partial sectional view as indicated in FIG. 1.

Means 21, as best shown in FIGS. 5 and 6, for positioning the impact hammer 18 within the cavity 4 includes means 118 for resiliently supporting the second end portion 73 of the impact hammer 18, and a collar assembly 119 for supporting the first end portion 72 of the impact hammer 18 and also sealing the cavity 34. The means 118 includes a pair of cushion assemblies 120. One of the cushion assemblies 120, as best shown in FIG. 6, is positioned in the lower mounting recess 76 of the second end portion 73 of the housing 71 and is fastened to the bottom plate 25 by a plurality of bolts, one of the plurality is shown at 122. The other one of the cushion assemblies 120 is positioned in the upper mounting recess 78 of the second end portion 73 of the housing 71 of the impact hammer 68 fastened to the curved body portion 26 by the plurality of bolts 122 (net shown). Each cushion assembly 120 includes a mounting plate 124 having a plurality of holes 126 through which the plurality of bolts 122 passes to attach the mounting plate 124 to either the curved body portion 26 or the bottom plate 25. The cushion assembly 120 includes a first plate 127 positioned in the mounting aperture 76,78. A second plate 128 is secured, in this particular embodiment by welding, to the mounting plate 124. An elastomeric pad 130 is positioned and bonded between the first plate 126 and second plate 128. The elastomeric pad 130 deflects and allows the impact hammer 18 to move when a force is applied to the cutting edge 50.

Figure 7:
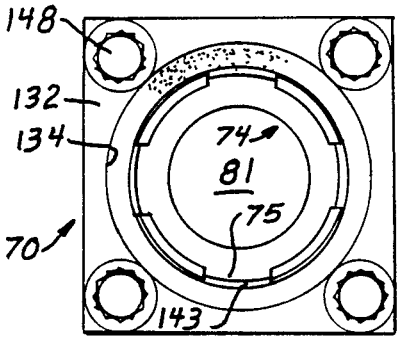
FIG. 7 is an end view of the impactor as indicated in FIG. 5.

The collar assembly 119, as best shown in FIGS. 5 and 7, includes a mounting plate 132 attached within the impactor cavity 34 of the bucket 14. The mounting plate 132 includes a central hole 134 and a plurality of mounting holes 136 adjacent the outer periphery. A resilient collar 138 is positioned rearwardly of and adjacent the plurality of locking tabs 75 around the reduced diameter portion 74 of the first end portion 72 of the impact hammer 14. The resilient collar 138 includes an inner ring 140 having a central bore 142 with a plurality of locking tabs 143, a outer plate 144, and a resilient pad 146 bonded between the inner ring 140 and the outer plate 144. The collar 138 is slipped over the reduced diameter portion 74 of the impact hammer 18 so that the tabs 75,143 slide past each other. When in position the collar is rotated to position the tabs 143 in contact with the tabs 75 of the impact hammer 18 to prevent movement of the impact hammer 18 in respect to the inner ring 140 of the collar 138. The outer plate 144 of the resilient collar 138 is attached to the mounting plate 132 by a plurality of bolts 148, one in each mounting hole 136 of the mounting plate. The bolts 148 pass through the mounting holes 136 and are threaded into the outer plate 144.

INDUSTRIAL APPLICABILITY

In the excavating and impacting process of the impact bucket apparatus 10 the movable manipulator 12 is used to move the bucket 14 toward the material which is to be impacted and excavated. When the teeth 70 or first edge portion 64 of the cutting element 60 engages the material the cutting edge assembly 16 is pivoted around the pin 58 toward the bucket 14. Continued movement of the cutting edge assembly 16 toward the bucket 14 will cause the impact surface 69 of the cutting edge 53 to contact the first impact surface 82 of the first piston 81 in the impact hammer 18. Movement of the cutting edge 52 will retract the first piston 81 into the impact hammer 18 to preload the impact hammer 18. The pivotal movement of the cutting edge assembly 16 is guided by the stub shaft 87 which is mounted on the cutting edge 53. The first piston 81 will continue to retract until the shoulder 84 on the piston contacts or abuts the shoulder 80 in the central bore 79 of the impact hammer 18 housing 71. With the shoulders 80,84 in abutment, continued movement of the cutting edge assembly 16 will also move the impact hammer 18. The elastomeric pads 130 and resilient pad 146 will deflect to allow the impact hammer 18 to move. Movement of the cutting edge assembly 16 toward the bucket 14 will be stopped when abutment surface 92 of the stub shaft 87 contacts the abutment surface 108 of the stop plate 104. When the impact hammer 18 is actuated the second piston 85 is propelled toward the first piston 81. The impact surface 86 of the second piston 85 strikes the second impact surface 83 of the first piston 81. The impact will extend the first piston 81 and pivotally move the cutting edge assembly 16 away from the bucket 14. Movement of the cutting edge assembly 16 away from the bucket 14 will cause the first edge portion 64 of the cutting edge 53 to impact the material which is to be excavated. This impacting will be repeated until the material breaks. When the material breaks and the cutting edge assembly 16 is allowed to pivot further away from the bucket the elastomeric insert 96 of the stub shaft 87 will contact the abutment surfaces 114 of stops 110 a limit the movement of the cutting edge assembly 16 away from the bucket 14. Inserts 116 of the stops 110 contact the stub shaft 87 to prevent lateral movement of the cutting edge assembly 16 during the pivotal movement thereof.

In view of the foregoing, it is readily apparent that the structure of the present invention provides an improved impact bucket apparatus which utilizes a resiliently mounted impact hammer to deliver impact blows to a movable cutting edge assembly which is guided during pivotal movement to prevent lateral movement of the cutting edge.

Other aspects, objects, and advantages of this invention can be obtained from a study of the drawings, the disclosure and the appended claims.

I claim:

1. An impact bucket apparatus adapted when in use to be pivotally mounted on a moveable manipulator of a vehicle, comprising:

a bucket having a pair of spaced apart side plates, each having upper and lower portions, a bottom plate attached to the lower portion of each of the side plates at the bottom thereof, and a curved body portion attached to each of the side plates and spaced from the bottom plate, the lower portions of the side plates, the bottom plate, and curved body portion define an impactor cavity having an opening within the bucket;

a cutting edge assembly includes a pair of spaced apart arms having upper and lower portions and a cutting edge having an edge portion and a reinforcing gusset defining an impact surface, the cutting edge being attached between and to the lower portions of the arms, the upper portions of the arms being pivotally attached to the upper portions of the side pates, the cutting edge being movable between a position adjacent the opening of the impactor cavity and a position spaced from the opening thereof;

means for guiding and limiting pivotal movement of the cutting edge assembly including a stub shaft attached to the cutting edge and having a distal end projecting therefrom into the mounting assembly; and an impact hammer located in the impactor cavity of the bucket and including a piston having an impact surface aligned with and positioned to contact the impact surface of the cutting edge.

2. The impact bucket apparatus of claim 1 wherein distal end of the stub shaft includes an enlarged end portion having an abutment surface on one side and a continuous axially facing groove on the opposed side which contains an elastomeric insert extending outwardly thereof.

3. The impact bucket apparatus of claim 2 wherein the guiding and limiting means includes a stop positioned within the mounting assembly, the stop having an abutment surface positioned to contact the abutment surface of the stub shaft to limit pivotal movement of the cutting edge assembly toward the opening of the impactor cavity.

4. The impact bucket apparatus of claim 2 wherein the guiding and limiting means includes a pair of stops positioned within mounting assembly, each of the stops having an abutment surface positioned to contact the elastomeric insert to limit the pivotal movement of the cutting edge assembly away from the opening of the impactor cavity.

5. The impact bucket apparatus of claim 4 wherein the elastomeric insert deforms and compresses to cushion contact force between the surface of the stub shaft and the pair of stops.

6. The impact bucket apparatus of claim 5 wherein the guiding and limiting means includes a pair of inserts to guide the stub shaft during pivotal movement of the cutting edge assembly.

7. The impact bucket apparatus of claim 1 wherein the bucket apparatus includes means for positioning the impact hammer within the impactor cavity of the bucket.

8. The impact bucket apparatus of claim 7 wherein the means for positioning the impact hammer in the impactor cavity of the bucket includes means for resiliently supporting the second end portion of the impact hammer having a pair of cushioning assemblies, one of the pair being positioned for interaction with the curved body portion and the impact hammer and the other one of the pair positioned for interaction with the bottom plate and the impact hammer.

9. The impact bucket apparatus of claim 8 wherein each of the cushioning assemblies include an elastomeric pad which deflects and allows the impact hammer to move when a force is applied to the cutting edge.

10. The impact bucket apparatus of claim 7 wherein the means for positioning the impact hammer in the impactor cavity further includes a collar assembly around the impact hammer to support the end of the impact hammer adjacent the cutting edge.

11. The impact bucket apparatus of claim 10 wherein the collar assembly includes a resilient pad which deflects to allow the impact hammer to move when a force is applied to the cutting edge assembly.

* * * * *

UNITED STATES PATENT AND TRADEMARK OFFICE

CERTIFICATE OF CORRECTION

PATENT NO. : 4,959,915

DATED : October 2, 1990

INVENTOR(S) : Michael A. Roussin and Brent C. Bargfrede

It is certified that error appears in the above-identified patent and that said Letters Patent is hereby corrected as shown below:

Claim 1, column 6, line 22, after "including" insert --a mounting assembly attached within the impactor cavity and--;

Claim 1, column 6, line 17, remove "pates" and insert --plates--.

Claim 2, column 6, line 30, after "wherein" insert --the--.

Claim 4, column 6, line 45, after "within" insert --the--.

Signed and Sealed this

Ninth Day of June, 1992

*Attest:*

DOUGLAS B. COMER

*Attesting Officer*

*Acting Commissioner of Patents and Trademarks*